United States Patent [19]

Tysver

[11] 4,390,112

[45] Jun. 28, 1983

[54] EASY OPENING CONTAINER AND OPENER TOOL THEREFOR

[75] Inventor: Oliver J. Tysver, Flossmoor, Ill.

[73] Assignee: The Continental Group, Inc., Stamford, Conn.

[21] Appl. No.: 314,167

[22] Filed: Oct. 23, 1981

[51] Int. Cl.[3] ..... B65D 17/36

[52] U.S. Cl. ..... 220/274; 81/3.46 R

[58] Field of Search ..... 220/274, 277; 30/450; 81/3.46 R, 3.37

[56] References Cited

U.S. PATENT DOCUMENTS

| | | | |
|---|---|---|---|
| 834,178 | 10/1906 | Williams | 220/274 |
| 838,204 | 12/1906 | Nichols | 220/274 |
| 1,814,487 | 7/1931 | Mueller | 220/277 |
| 2,017,077 | 10/1935 | Schoettel | 220/274 |

FOREIGN PATENT DOCUMENTS

| | | |
|---|---|---|
| 30670 | 4/1920 | Norway . |
| 31866 | 2/1921 | Norway . |
| 32232 | 4/1921 | Norway . |

*Primary Examiner*—George T. Hall

*Attorney, Agent, or Firm*—Charles E. Brown

[57] ABSTRACT

An easy opening can and key combination, wherein the can has a circumferential score encircling the can body beneath the double seam attaching the body to the end member, the key comprising a handle having a jaw at one end with inner and outer jaw elements embracing the seam, the outer element extending below the seam and having an end alignable with the score in a position such that when the handle is pressed downwardly it swings about the seam and the outer jaw member ruptures the score whereupon the tool is swung laterally and slightly upwardly separating the upper portion of the can from the body.

10 Claims, 5 Drawing Figures

FIG. 1
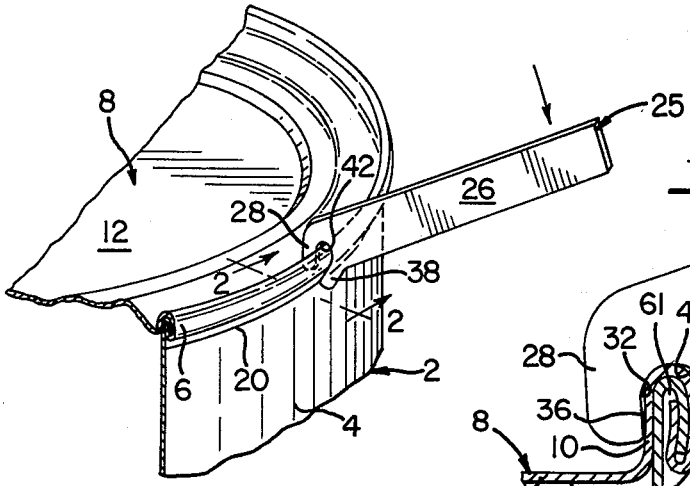
FIG. 2
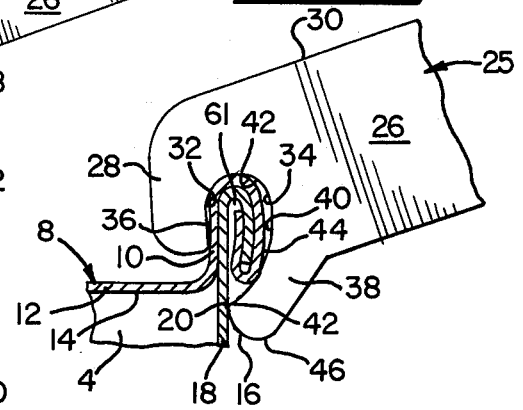
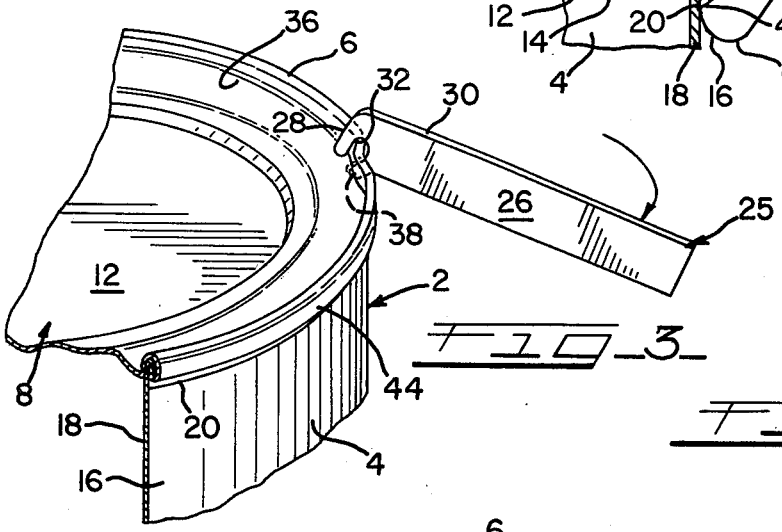
FIG. 3
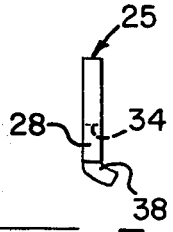
FIG. 5
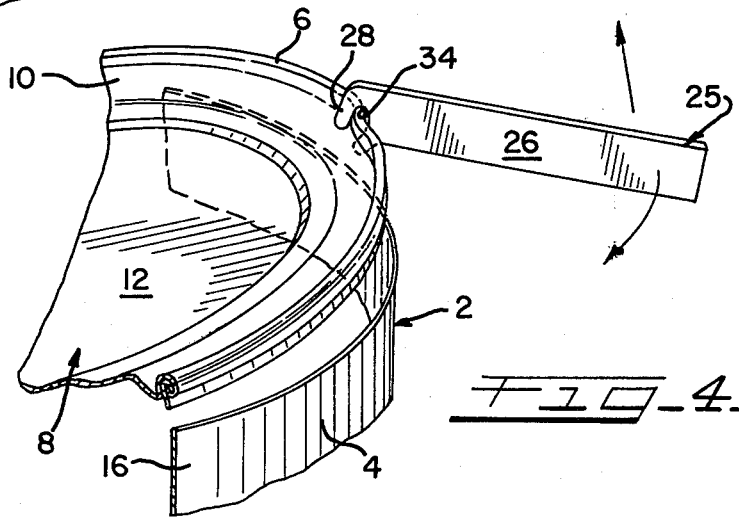
FIG. 4

EASY OPENING CONTAINER AND OPENER TOOL THEREFOR

BACKGROUND OF THE INVENTION

Containers of the easy opening type having a scored end panel and an opening device attached to the end panel are well known. Scores and strips openable by keys in the container bodies have also been commercialized.

DISCUSSION OF THE PROBLEMS

The end panel opening devices require expensive tooling to make and add to the cost of the can and the body score. Strips require an end tab which must be inserted into slot in a key. The provision of such tab complicates the formation of the can. If the can is of the welded type or two-piece, such tabs cannot be provided. In soldered cans, the strip separates at the soldered seam. In a welded can, such tab complicates the welding operation and, when pulled, would break off across the weld.

SUMMARY OF THE INVENTION

This invention is directed to a novel container and opening device wherein the container body is scored about its entire perimeter immediately below the chime formed between the end panel and the body. The opening key has an elongated hand-graspable handle or shank at one end of which there is provided a chime-admitting slot open downwardly and endwise of the handle formed by a pair of fingers, the inner one of which engages against the inside of the chime and the other, or outer one, extends downwardly and laterally about and below the outer edge of the chime and has an end point which aligns with the score. The tool is first moved downwardly which punctures the can by breaking a portion of the score and causes the outer finger to move further under the chime. While the can is held with one hand, the tool is then shifted with the other hand laterally and lifted slightly upwardly to further break the score and progress the break entirely around the body. If need be, the key may be repositioned and operated as disclosed in different areas about the periphery of the can.

A principal object is to provide a simplified openable can and a key arrangement for facilitating opening of the can.

These and other objects inherent in and encompassed by the invention will become more apparent from the specification and the drawings, wherein:

FIG. 1 is a fragmentary perspective view of the can with the key applied thereto according to the invention preparatory to opening of the can;

FIG. 2 is an enlarged sectional view taken substantially on line 2—2 of FIG. 1;

FIG. 3 is a view similar to FIG. 1 showing the key in rupturing position to the can score;

FIG. 4 is a view similar to FIGS. 1 and 3 showing the can parts separated; and FIG. 5 is a fragmentary end view of the key taken from the jaw end thereof.

DESCRIPTION OF THE INVENTION

The invention as shown comprises a can 2 having a body 4 with a typical seam or chime 6 joining the body to an end panel 8 which has an axially extending chuck wall portion 10 and a center panel portion 12. The panel portion extends normal to the can axis. Slightly below the plane of the bottom side 14 of the center panel portion there is provided, preferably in the external side 16 of the body wall 18, a weakening line or score 20 completely encircling the body 4.

An opening key 25 has been provided for opening the can 2. The key comprises a flat rectangular metal body 26 in the form of an elongated bar member having at one end a pair of fingers or jaw members. The inner jaw member 28 lies in the plane of the body 26 and projects downwardly approximately normal to the upper edge 30 of the body 26 of the key. The jaw 28 has a flat inner edge 32 which is also approximately normal to the upper edge and defines the inner side of a somewhat C-shaped notch or slot 34. Edge 32 is adapted to lie substantially flat-face against the inner side 36 of the axially extending chuck wall portion 10. As is shown in FIG. 2, the effective height of the jaw member 28 is less than that of the chime 6. The outer jaw 38, which has a curved concave inner edge surface 40, forms the opposite side of slot 34 and merges into the concave bight edge surface 42 at the top of the slot 34. The surface 40 meshes at its inner end with the upper edge of surface 32.

It will be noted that the jaw member 38 is bent laterally slightly to one side of the body or shank 26 of the tool and is adapted to fit about the outer side 44 of the chime and extend thereunder. As best seen in FIG. 2, the bottom rounded convex edge 46 of the jaw 38 intersects the lower edge of the inner surface 40 in a point 42 which, in the use position of the tool, preferably aligns with the score 30.

In effect, the tool is hooked onto the chime and is swingable downwardly thereon by the user applying appropriate force on the shank or handle of the tool. This effects rupturing of a portion of the score thereadjacent. Thereafter, the user merely swings the tool laterally (circumferentially) of the can and also applies a slight lifting motion to the tool with or without a twist which causes the score to break further around the perimeter of the can body. If necessary, the key or tool may be shifted circumferentially about the can and the score again broken by a downward force on the key. A further lateral swinging motion with a slight lift will complete the break of the score until the entire top portion may be separated from the bottom portion of the can.

What is claimed is:

1. The combination of a can having a body and an end member seamed together in a chime, a weakening score encircling said body immediately below the chime, a tool for fracturing said score and removing said end member and a portion of said body between said score and chime to open said can, said tool having a jaw with inner and outer portions embracing said chime and operative attendant to movement of said tool in one direction to fracture said score, said tool having means engageable under said chime to permit lifting of the tool to fracture the entire score and separate the can portion above the score from said body.

2. The invention according to claim 1 and said end member having an axially extending chuck wall and said inner jaw portion having an edge extending therealong and said outer jaw portion being curved over the top and outside of the chime and extending thereunder and having an end in position to pierce said score upon predetermined movement of the tool.

3. The invention according to claim 2 and said outer jaw portion having a laterally extending end portion engageable with the side wall of the can.

4. The invention according to claim 1 and said inner and outer jaw portions formed or arranged to complimentally fit about said chime.

5. The invention according to claim 1 and said tool comprising a body having laterally spaced edges and said jaw portions extending generally in the same direction from respective edges and defining a chime-admitting notch therebetween.

6. A tool for opening a metal can having a body with a circumferential score and a seam thereadjacent connecting an end member to a body, said tool having a handle and a pair of jaw members defining a seam-admitting notch at one end of said handle and sloping downwardly therefrom, said jaw members underlying said notch in projecting relation and having a portion for fracturing the score attendant to prescribed manipulation of the tool.

7. A tool according to claim 6 wherein said handle is in the form of an elongated bar, the other of the jaw members being approximately normal to the length of said bar, and said notch adjacent said other jaw member being of a depth less than the height of the intended seam.

8. A tool according to claim 6 wherein said other jaw member lies in the plane of said handle and said one jaw member is disposed out of and at an angle to the plane of said handle wherein said jaw members are laterally offset with respect to each other for engagement with circumferentially spaced portions of a can.

9. A tool according to claim 8 wherein said one tool has a pressure concentrating point for engagement with a can score.

10. A tool according to claim 7 wherein said other jaw member lies in the plane of said handle and said one jaw member is disposed out of and at an angle to the plane of said handle wherein said jaw members are laterally offset with respect to each other for engagement with circumferentially spaced portions of a can.

* * * * *